US006200941B1

(12) United States Patent
Strandburg et al.

(10) Patent No.: US 6,200,941 B1
(45) Date of Patent: Mar. 13, 2001

(54) FULLY DILUTED HARD SURFACE CLEANERS CONTAINING HIGH CONCENTRATIONS OF CERTAIN ANIONS

(75) Inventors: Gary M. Strandburg, Mt. Pleasant; Daniel H. Haigh, Sanford; John M. Gardner, Midland; Kevin J. Wagers, Midland; Erin D. O'Driscoll, Midland, all of MI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 08/708,473

(22) Filed: Sep. 5, 1996

Related U.S. Application Data

(60) Provisional application No. 60/003,321, filed on Sep. 6, 1995.

(51) Int. Cl.[7] ..... C11D 1/75; C11D 3/395; C11D 7/10

(52) U.S. Cl. ..... 510/238; 510/191; 510/199; 510/235; 510/236; 510/237; 510/245; 510/252; 510/259; 510/362; 510/363; 510/365; 510/367; 510/368; 510/373; 510/379; 510/380; 510/382; 510/384; 510/391; 510/503; 510/504; 510/509

(58) Field of Search ..... 510/191, 199, 510/235, 236, 237, 238, 245, 252, 259, 362, 363, 365, 367, 368, 373, 379, 380, 382, 384, 391, 503, 504, 509

(56) References Cited

U.S. PATENT DOCUMENTS

| | | | | |
|---|---|---|---|---|
| 4,065,409 | * | 12/1977 | Flanagan | 252/528 |
| 4,174,304 | | 11/1979 | Flanagan | 252/524 |
| 4,240,919 | * | 12/1980 | Chapman | 252/95 |
| 4,282,109 | | 8/1981 | Citrone et al. | 252/102 |
| 4,336,151 | * | 6/1982 | Like et al. | 252/106 |
| 4,337,163 | | 6/1982 | Schilp | 252/96 |
| 4,349,448 | | 9/1982 | Steele | 252/135 |
| 4,352,678 | | 10/1982 | Jones et al. | 51/307 |
| 4,507,424 | | 3/1985 | Webster | 524/442 |
| 4,581,161 | | 4/1986 | Nedonchelle | 252/550 |
| 4,606,850 | * | 8/1986 | Malik | 252/528 |
| 4,614,606 | * | 9/1986 | Machin et al. | 252/116 |
| 4,627,931 | | 12/1986 | Malik | 252/153 |
| 4,695,394 | | 9/1987 | Choy et al. | 252/97 |
| 4,769,172 | | 9/1988 | Siklosi | 252/153 |
| 4,772,414 | | 9/1988 | Marzec et al. | 252/103 |
| 4,783,283 | * | 11/1988 | Stoddart | 252/547 |
| 4,921,629 | * | 5/1990 | Malihi et al. | 250/170 |
| 4,966,724 | | 10/1990 | Culshaw et al. | 252/158 |
| 5,034,150 | | 7/1991 | Smith | 252/187.25 |
| 5,061,395 | | 10/1991 | Meng | 252/173 |
| 5,089,162 | | 2/1992 | Rapisarda et al. | 252/102 |
| 5,185,096 | | 2/1993 | Ahmed | 252/99 |
| 5,279,758 | | 1/1994 | Choy | 252/104 |
| 5,281,280 | | 1/1994 | Lisowski et al. | 134/26 |
| 5,348,682 | * | 9/1994 | Finley et al. | 252/186.36 |
| 5,376,296 | | 12/1994 | Dutcher | 252/102 |
| 5,415,797 | | 5/1995 | Ishida et al. | 252/135 |
| 5,435,935 | * | 7/1995 | Kupneski | 252/156 |
| 5,470,499 | * | 11/1995 | Choy et al. | 252/99 |
| 5,516,459 | * | 5/1996 | Van Eenam | 252/547 |
| 5,529,711 | * | 6/1996 | Brodbeck et al. | 252/102 |
| 5,624,891 | * | 4/1997 | Smialowicz et al. | 510/195 |

* cited by examiner

*Primary Examiner*—Yogendra Gupta
*Assistant Examiner*—Charles Boyer

(57) ABSTRACT

Fully diluted hard surface cleaners are disclosed which are particularly effective on cleaning soap scum. The cleaners contain at least 0.45 eq/kg of a dissolved anion which reacts with calcium ion to form an insoluble salt. The cleaners also contain a particular amine oxide, or a different surfactant in conjunction with a solvent. Preferred embodiments include a bleach, which provide for a cleaner which is effective on soap scum and mold and mildew.

4 Claims, No Drawings

FULLY DILUTED HARD SURFACE CLEANERS CONTAINING HIGH CONCENTRATIONS OF CERTAIN ANIONS

This application claims the benefit of U.S. Provisional application No. 60/003,321 filed Sep. 6, 1995.

BACKGROUND OF THE INVENTION

This invention relates to hard surface cleaners, particularly cleaners for soap scum and mold and mildew.

Bathroom cleaners targeted at removing soap scum from hard surfaces such as bathroom tiles and countertops are well known in the art. Among commercial cleaners of these type are Lysol Basin Tub and Tile Cleaner. Because soap scum has proven to be difficult to clean, the commercial cleaners aimed at soap scum removal tend to contain relatively high levels of chelating agent and solvent (typically, >4% of each). The chelant of choice in these cleaners has been the tetrasodium salt of ethylenediamime tetraacetic acid (EDTA). In U.S. Pat. No. 4,264,479 to Flanagan is described a cleaning composition targeted at soap scum removal. That composition contains about 6 weight percent of chelants and about 3 weight percent of solvents. Compositions such as these are effective at removing soap scum, but are disadvantageous in that they have significant raw material costs due to high levels of chelants and solvents. In addition, some of these products contain high levels of solids, and thus have the disadvantage of leaving streaks and residuals when they are used. However, this latter problem cannot be solved through dilution, because high chelant and solvent levels are needed in those compositions to effectively remove the soap scum.

It would therefore be desirable to provide a cleaner which is effective on soap scum, but which uses lower amounts of expensive ingredients and does not significantly streak or leave significant residue when it is used.

A further disadvantage of these previously known soap scum cleaners is that they are ineffective in cleaning mold and mildew. Because mold and mildew are common problems on surfaces where soap scum is often found, it is highly desirable to provide a cleaner which is effective on both of these materials.

SUMMARY OF THE INVENTION

This invention is a cleaning composition comprising (a) at least 85% by weight water, in which is dissolved (b) at least about 0.45 equivalent per kilogram of the composition of an inorganic anion which, when combined with calcium ion, forms a salt which has a solubility of not more than 0.2 g/100 g water at 25° C., or a mixture of such inorganic anions. The composition further contains (c) (1) at least about 0.3% by weight, based on the weight of the composition, of at least one detersive surfactant. When component (c) (1) does not include an amine oxide of the form $RR^1R^2N\rightarrow O$ wherein R is $C_6$–$C_{12}$ alkyl and $R^1$ and $R^2$ are independently $C_{1-4}$ alkyl or $C_{1-4}$ hydroxyalkyl, said composition further contains (c) (2) an organic solvent of a type and of an amount that, at the relative proportions present in the cleaning composition, the water, surfactant and the solvent together form a clear mixture. The cleaning composition is alkaline and is substantially devoid of a phosphorous-containing salt.

It has been found that the selection of a particular surfactant or surfactant/solvent package, in combination with the presence of the dissolved anions, provides for a fully diluted cleaner which is particularly effective for removing soap scum. This result is achieved even though the cleaner contains relatively low levels of active ingredients, and low levels of surfactant and solvent in particular, and even in the absence of common components of soap scum cleaners, such as chelating agents and abrasives.

The embodiments of this invention which contain a bleach are of particular interest, as they provide a cleaner which is effective on soap scum and mold and mildew. Heretofore, it has been difficult to provide a cleaner which was effective for cleaning all of these soils because the bleaches, particularly the chlorine-releasing bleaches, and the most common solvents and chelating agents which formed the backbone of many conventional soap scum cleaners are incompatible.

DETAILED DESCRIPTION OF THE INVENTION

The cleaning composition of this invention contains one or more dissolved inorganic anion(s) which, when combined with calcium ion, form(s) a salt which has a solubility of not more than 0.2 g/100 g water at 25° C. For the purposes of this invention, calcium hydroxide is not considered as a "salt", and the suitable dissolved anions do not include hydroxide ion. The dissolved anion(s) is present in an amount of at least 0.45 equivalent per kilogram of the cleaning composition, preferably at least about 0.55 equivalents/kilogram, more preferably at least about 0.65 equivalents/kilogram. The maximum amount of said anion(s) is limited by the requirement of at least 85% water; however, the cleaning composition typically contains up to about 1.5 equivalents of the anion per kilogram and preferably up to 1.3 equivalents thereof per kilogram. In the case where two or more suitable anions are present, the foregoing amounts apply to the combined concentration of all the suitable anions. In a composition containing hydroxide ions, the hydroxide ions are not included in the calculation of the amount of suitable ions.

The anion is typically present in the form of an aqueous solution of a soluble salt, and normally exists in conjunction with a cation as a hydrated ion pair.

Suitable anions include fluoride ion, carbonate ion ($CO_3^{=}$), metasilicate ion ($SiO_3^{=}$) and tungstate ion, with carbonate, fluoride and metasilicate ion being preferred, and carbonate being most preferred.

The anion can be provided to the cleaning composition by dissolving a water-soluble salt of that anion in water in a quantity sufficient to provide the required amount of dissolved anion. Generally useful salts include those having a monovalent cation, preferably an alkali metal or ammonium, more preferably sodium or potassium. Thus, for example, the anion can be provided by dissolving a salt such as sodium or potassium fluoride, sodium or potassium carbonate, sodium or potassium metasilicate or sodium or potassium tungstate in water. The other ingredients described hereinafter may be added to the water before, simultaneously with, or after the salt.

The carbonate and tungstate ions can be generated by complete in situ neutralization of the corresponding acids or the bicarbonate or bitungstate intermediates in sufficient quantities to form at least 0.45 equivalent of the carbonate or tungstate ion per kilogram of cleaning solution.

The cleaning composition of this invention includes at least about 85% water, based on the weight of the entire composition. The source of the water is not particularly important. Tap water, distilled water, deionized water and the like are all suitable provided that any impurities in the water do not adversely interfere with the function of the other components in the cleaning composition. The water preferably constitutes at least about 88, more preferably at least about 90 weight percent of the composition, and preferably up to about 95 weight percent, more preferably up to about 93 weight percent.

In addition to the dissolved anion and the water, the cleaning composition contains at least one detersive surfactant. For the purposes of this invention, a surfactant is considered to be a "detersive" one if it or another surfactant of substantially the same chemical structure is indicated as being useful in detergents or cleaners in McCutcheon's Volume 1: Emulsifiers & Detergents 1995 North American Edition (McCutcheon's Division, MC Publishing Co. Glen Rock N.J.), or performs equivalently to one or more of such surfactants. Among the detersive surfactants that are useful in this invention, those which are of particular interest are amine oxides of the form $RR^1R^2N\rightarrow O$, wherein R is $C_6$–$C_{12}$ alkyl and $R^1$ and $R^2$ are independently $C_{1-4}$ alkyl or $C_{1-4}$ hydroxyalkyl. The amine oxide surfactants of this type have the surprising advantage that they can be used in this composition without need for a separate solvent (component (c) (2)). These amine oxides assist the cleaning composition in penetrating soap scum, thereby facilitating its removal. Among these amine oxides, the preferred ones are $C_{6-12}$ alkyl dialkyl amine oxides and the most preferred ones are $C_{8-12}$ alkyl dimethyl amine oxides.

If the surfactant does not include one of the aforementioned amine oxides, then it also contains a solvent as described below. In this latter case, a large number of surfactants are suitable, including anionic, nonionic, cationic and zwitterionic surfactants. Mixtures of two or more such surfactants can be used as long as the surfactants are compatible with each other and the other ingredients in the composition.

Useful nonionic surfactants, which must be used in conjunction with a solvent when the aforementioned amine oxide is not present, include amine oxide surfactants containing an alkyl group of greater than 12 carbon atoms, alkylphenol ethoxylates, linear and branched alcohol ethoxylates, carboxylic acid esters, alkanolamides, alkylpolyglycosides, ethylene oxide/propylene oxide copolymers, and the like. Preferred among these are linear and secondary alcohol ethoxylates, octyl- and nonyl-phenol ethoxylates, alkanol amides and alkylpolyglycosides.

Useful zwitterionic surfactants, which must be used in conjunction with a solvent when the aforementioned amine oxide is not present, include alkyl aminopropionic acids, alkyl iminopropionic acids, imidiazoline carboxylates, alkylbetaines, sulfobetaines, and sultaines, of which the last three are preferred.

Useful cationic surfactants, which must be used in conjunction with a solvent when the aforementioned amine oxide is not present, include, for example, primary amine salts, diamine salts, quaternary ammonium salts, and ethoxylated amines.

Useful anionic surfactants, which must be used in conjunction with a solvent when the aforementioned amine oxide is not present, include carboxylic acid salts, alkyl benzene sulfonates, secondary n-alkane sulfonates, alpha-olefin sulfonates, dialkyl diphenylene oxide sulfonates, sulfosuccinate esters, isoethionates, linear alcohol sulfates (alkyl sulfates), and linear alcohol ethoxy sulfates. Preferred among these are the alkali metal or ammonium salts of lauryl sulfate, dodecylbenzene sulfonates, alcohol ether sulfates, and isethionates.

At least about 0.3 weight percent surfactant, based on the weight of the entire composition, is needed in order for the cleaning composition to be effective for cleaning soap scum. On the other hand, greater than about 10% by weight of surfactant tends not to be cost-effective. Beyond these broad ranges, it is also necessary, when the surfactant does not include an amine oxide as described before, that the amount and type of the surfactant be such that it forms a clear stable mixture with the water and the solvent, when present, at the relative proportions thereof which are present in the cleaning composition. The ability of the water, surfactant and solvent to form such a clear stable mixture can be tested by combining the three components, in the same relative quantities but in the absence of the other components, and observing it visually. If the mixture is clear and does not separate into distinct phases, as determined by the naked eye, the mixture is clear and stable for the purposes of this invention.

Preferably, at least about 0.35, more preferably at least about 0.5 weight percent surfactant is present and preferably no more than about 5, more preferably no more than about 3, most preferably no more than about 2.5 weight percent surfactant is present when the cleaner is in the form of a low viscosity fluid. When a higher viscosity gel is desired, it is preferred to have at least about 2.0 weight percent surfactant, more preferred to have at least about 2.5 weight percent, most preferred at least about 2.75 weight percent, and preferably up to about 6 percent surfactant, more preferably up to about 4.5 percent. The foregoing amounts apply to the amine oxide surfactants described before as well as to the other surfactants.

When the surfactant does not include an amine oxide of the form $RR^1R^2N\rightarrow O$, wherein R is $C_{6-12}$ alkyl and $R^1$ and $R^2$ are independently $C_{1-4}$ alkyl or $C_{1-4}$ hydroxyalkyl, the cleaning composition further contains an organic solvent. The organic solvent is not a detersive surfactant as described before. As mentioned before, the solvent type and its amount must be such that it forms, together with the surfactant and the water, a clear stable mixture. Such a solvent may be present when the amine oxide surfactant is used, but in that instance its use is optional.

Suitable solvents include terpenes, aliphatic hydrocarbons and alpha-olefins. However, the solvent preferably contains at least one oxygen atom, preferably a alcoholic or ether oxygen. Among these oxygen-containing solvents are aliphatic alcohols of up to 8 carbon atoms, particularly tertiary alcohols of up to 8 carbon atoms; aromatic-substituted alcohols; alkylene glycols of up to 6 carbon atoms; polyalkylene glycols having up to 6 carbon atoms per alkylene group; mono- or dialkyl ethers of alkylene glycols or polyalkylene glycols having up to 6 carbon atoms per glycol group and up to 6 carbons atoms in each alkyl group; mono- or diesters of alkylene glycols or polyalkylene glycols having up to 6 carbon atoms per glycol group and up to 6 carbon atoms in each ester group; and the like. Specific examples of preferred solvents include t-butanol, t-pentyl alcohol, 2,3-dimethyl-2-butanol, benzyl alcohol or 2-phenyl ethanol, ethylene glycol, propylene glycol, propylene glycol mono-n-butyl ether, dipropylene glycol mono-n-butyl ether, propylene glycol mono-n-propyl ether, dipropylene glycol mono-n-propyl ether, diethylene glycol mono-n-butyl ether, ethylene glycol mono-n-butyl ether, diethylene glycol monomethyl ether, dipropylene glycol monomethyl ether, triethylene glycol, propylene glycol monoacetate, dipropylene glycol monoacetate, and the like. The solvent preferably constitutes no more than about 6 weight percent of the composition, more preferably no more than about 4 weight percent, most preferably no more than about 3 weight percent. However, when a chlorine-releasing bleach is present, the solvent is preferably not an alkylene glycol, a polyalkylene glycol or a ester or ether thereof, and preferably is a tertiary alcohol.

Particularly preferred embodiments of the invention include a bleach. By including a bleach, a hard surface cleaner is made which is effective both on soap scum as well as mold and mildew.

Suitable bleaches include chlorine-releasing agents and peroxy compounds. Among these, agents which release hypochlorite ion ($OCl^-$) in alkaline solution are useful, such as alkali metal or alkaline earth metal hypochlorites, hypochlorite addition products, chloramines, chlorimines, chloramides and chlorimides. Alkali metal hypochlorites are more preferred and sodium or potassium hypochlorite are most preferred. The use of such chlorine-containing bleaches in soap scum cleaners has not been possible with previous soap scum cleaners, due to the use of relatively high amounts of chelants and/or solvents, which are incompatible with these types of bleaches. Thus, the ability to provide good soap scum cleaning together with a chlorine-releasing bleach to clean mold and mildew is a significant advantage of this invention.

When present, the bleach advantageously constitutes at least about 0.5% by weight of the cleaning composition, preferably from about 1%, more preferably from about 2 percent, up to about 10%, preferably up to about 5%, more preferably up to about 4%, most preferably up to about 3%, except when a gelled product is prepared. In that case, the bleach advantageously constitutes at least about 0.5 percent of the weight of the composition, up to about 2 weight percent, preferably up to about 1.5 weight percent.

In addition to the foregoing components, the cleaning composition of this invention contains one or more optional ingredients such as abrasives, buffers, fragrances, colorants, disinfectants, chelating agents, and the like. With respect to some of these, however, it is preferred that they either be absent or present only in limited quantities. In general, it is preferred that the cleaning composition be of low viscosity (less than 100 cps preferably less than 30 cps, more preferably less than 20 cps), although in some cases, particularly when an anionic surfactant is present, a gelled or viscous cleaner can be made. A clear (except for opacifying agents) stable cleaning composition is preferred, as is one which leaves essentially no residue when used to clean hard surfaces.

For example, abrasives can be used in this invention, but their inclusion is generally unnecessary and causes problems such as streaking, increased viscosity, and heterogeneity. As a result, it is preferred that the cleaning composition of this invention be essentially free of an abrasive.

Similarly, although a chelating agent can be used, large amounts thereof are unnecessary and add little to the effectiveness of the cleaner in removing soap scum. As a result, the cleaning composition advantageously contains no more than about 3 weight percent of a chelating agent, preferably no more than about 2 weight percent, more preferably no more than 1.0 weight percent, most preferably no more than about 0.75 weight percent and in many embodiments contains essentially no chelating agent. For the purposes of this invention, a chelating agent is a compound having two or more nonmetal atoms which can form coordinate links to a single metal ion to form a heterocyclic ring containing the metal ion. Examples of such chelating agents include citric acid, ethylene diamine tetraacetic acid, nitrilotriacetic acid, and their alkali metal salts.

The cleaning composition of this invention is substantially devoid of phosphorous-containing salts, such as are commonly used as builders in cleaning compositions. Such phosphorous-containing salts include alkali metal tripolyphosphates, pyrophosphates, phosphates and the like.

It is also preferred that the cleaning composition does not include urea, monoethanolamine, diethanolamine, triethanolamine or a sodium, potassium or alkanol ammonium salt of xylene-, toluene-, ethylbenzene- and isopropylbenzene sulfonates. These materials are sometimes included in cleaning compositions as hydrotropes, but are not needed in this invention because the surfactant and solvent are chosen so as to provide a clear mixture.

If necessary, a base or a buffer may be added to the cleaning composition to adjust the pH to above 7.0. Alkali metal hydroxides such as sodium hydroxide and potassium hydroxide are preferred. When a chlorine-releasing bleach is present, the cleaning composition preferably contains an alkali metal hydroxide in an amount sufficient to maintain the pH from about 7.5, more preferably about 8.0, most preferably about 9.0 to about 12, more preferably about 11.5, most preferably about 11.0. In general, up to about 1 weight percent, preferably up to about 0.5 weight percent, of an alkali metal hydroxide is sufficient for that purpose. When carbonate ion is present in the composition, bicarbonates can form as the pH is lowered. Thus, it is important to maintain the pH when carbonate ion is present so that the concentration of the critical anions remains in the ranges described above.

Suitable disinfectants include, for example, chlorhexidine, glutaraldehyde, formaldehyde, betaines, phenols and quaternary ammonium compounds such as Variquat 50 MC, commercially available from Sherex; BTC 2125M, commercially available from Stephan; and Barquat 4280Z, commercially available from Lonza.

In most cases, the cleaning composition can be prepared by adding its components to each other in any order. When the anion is added by adding an acid followed by neutralization with a base, it may be necessary to add acid-reactive components after the acid is neutralized. Generally, simple mixing of the components is all that is necessary. When a bleach is present, it is preferably added after at least the surfactants are added to the water, and preferably after all other components have been added.

The cleaning composition of this invention is particularly suitable as a fully diluted hard surface cleaner. As such, it can be used without further dilution by applying it at full strength to a soiled hard surface, and wiping or scrubbing to remove the soil. The cleaning composition is especially useful for cleaning kitchen or bathroom surfaces which are soiled with soap scum. Although this invention is not limited to any theory, it is believed that soap scum is removed by a two step, ion exchange process. Firstly, the calcium of the soap scum soil is exchanged by a monovalent cation that is associated with the critical anion in solution, forming a substantially water soluble fatty acid salt. Secondly, the free calcium is then precipitated from solution as an insoluble salt by reaction with the critical dissolved anion, which prevents regeneration of the soap scum.

Those embodiments of the invention which contain bleach are of particular value for cleaning hard surfaces containing both soap scum and mildew or mold, such as are often found in bathrooms.

The following examples are provided to illustrate the invention, but are not intended to limit the scope thereof. All parts and percentages are by weight unless otherwise indicated. All weights are reported as 100% active weights; any water included with the components is reported together with the added water.

EXAMPLE 1

A mildly alkaline cleaner is prepared by mixing the following ingredients in the order shown, with stirring until the potassium fluoride is fully dissolved:

| Ingredient | Parts by Weight | Equivalents anion/kg |
|---|---|---|
| Water | 93.5 | |
| Potassium fluoride | 5.0 | 0.86 |
| Decyldimethylamine oxide | 1.5 | |

The resulting cleaner is tested for efficacy in cleaning soap scum as described following Example 6. The results obtained are as reported in Table 1.

EXAMPLE 2

An alkaline cleaner is prepared by mixing the following ingredients in the order shown, with stirring until the sodium carbonate is completely dissolved.

| Ingredient | Parts by Weight | Equivalents anion/kg |
|---|---|---|
| Water | 94.2 | |
| Sodium Carbonate | 4.5 | 0.85 |
| Decyldimethylamine oxide | 1.0 | |
| Quaternary amine antimicrobial[1] | 0.3 | |

[1]BARQUAT 4280Z, sold by LONZA. A mixture containing n-alkyl (C12–C18) dimethylbenzyl ammonium chloride (40%), and n-alkyl (C12–C18) dimethylethylbenzyl ammonium chloride (40%).

The resulting cleaner is tested for efficacy in cleaning soap scum as described following Example 6. The results obtained are as reported in Table 1.

EXAMPLE 3

An alkaline cleaner is prepared by mixing the following ingredients in the order shown, with stirring until the potassium carbonate is completely dissolved.

| Ingredient | Parts by Weight | Equivalents anion/kg |
|---|---|---|
| Water | 88.2 | |
| Diethylene glycol n-butyl ether | 6.0 | |
| Potassium carbonate | 4.0 | 0.58 |
| Nonylphenol ethoxylate (Tergitol ® NP-10) | 1.0 | |
| Tetrasodium EDTA | 0.5 | |
| BARQUAT 4280Z (see Note 1) | 0.3 | |

The resulting cleaner is tested for efficacy in cleaning soap scum as described following Example 6. The results obtained are as reported in Table 1.

EXAMPLE 4

An alkaline cleaner is prepared by mixing the following ingredients in the order shown, with agitation until the sodium metasilicate is completely dissolved.

| Ingredient | Parts by Weight | Equivalents anion/kg |
|---|---|---|
| Water | 91.5 | |
| Dipropylene glycol n-butyl ether | 2.5 | |
| Sodium Metasilicate ($Na_2O.SiO_2$) | 5.0 | 0.82 |
| Sodium dodecylsulfate | 1.0 | |

The resulting cleaner is tested for efficacy in cleaning soap scum as described following Example 6. The results obtained are as reported in Table 1.

EXAMPLE 5

An alkaline cleaner is prepared by mixing the following ingredients in the order given, with agitation until the potassium carbonate is fully dissolved.

| Ingredient | Parts by Weight | Equivalents anion/kg |
|---|---|---|
| Water | 88.2–91.2[2] | |
| Potassium carbonate | 4.5 | 0.65 |
| Decyldimethylamine oxide | 1.0 | |
| Sodium hydroxide | 0.3 | |
| Sodium hypochlorite | 3.0 | |

[2]Examples containing sodium hypochlorite report water as a range, because sodium hypochlorite can contain varying amounts of sodium chloride as an impurity, up to approximately 1:1 by weight of sodium hypochlorite. Provided that the water content is at least 85%, the presence of the sodium chloride does not affect the results obtained.

The resulting cleaner is tested for efficacy in cleaning soap scum as described following Example 6. The results obtained are as reported in Table 1.

The substitution of the potassium carbonate with the same number of equivalents of sodium carbonate, sodium metasilicate or potassium silicate yields substantially similar results as are obtained with Example 5.

EXAMPLE 6

An alkaline cleaner is prepared by mixing the following ingredients in the order given, with agitation until the potassium carbonate is fully dissolved.

| Ingredient | Parts by Weight | Equivalents anion/kg |
|---|---|---|
| Water (see note 2) | 87.2–90.2 | |
| Potassium carbonate | 4.5 | 0.65 |
| 2,3-dimethyl-2-butanol | 1.0 | |
| Sodium 2-ethylhexyl sulfate | 1.0 | |
| Sodium hydroxide | 0.3 | |
| Sodium Hypochlorite | 3.0 | |

The resulting cleaner is tested for efficacy in cleaning soap scum as described following this Example. The results obtained are as reported in the following Table 1.

Evaluation of Examples 1–6, and Comparative Samples A and B

Cleaning efficiency is assessed using a modified method as follows. An artificial soap scum is prepared by dissolving sodium salts of oleic acid and stearic acid in hot water and then adding the resulting solution to an excess of an aqueous solution of calcium chloride while homogenizing. A precipitate forms, which is filtered, washed with hot water and dried to a constant weight under vacuum. The solid precipitate is dispersed in chloroform and 5.0 g of Sudan Red III dye are added per Kg of precipitate.

The dyed dispersion contains 2.1 weight percent calcium salts. It is sprayed onto standard 4.5 inch by 5 inch white enameled steel tiles with an airbrush so that approximately 50 mg of calcium fatty acid salts are loaded onto each tile. The weight of artificial soap scum on each tile is recorded. The tiles are rank ordered by soap scum mass such that averaged strokes to clean (STC) scores can be calculated from members of a tile series having nearly the same average mass of artificial soap scum. The relative humidity is monitored so as to test all of the cleaners under the same conditions (approximately 30–50% relative humidity) because humidity affects the hardness of the soil.

A Gardner Linear Scrubber is used to evaluate the cleaners, with the head being modified to accept two 1.75 inch×3.25 inch×1.0 inch Estracell sponges (Armaly Company). The sponges are mounted side by side with a space of 0.25 inch between them. The sled cover has a 0.25 inch diameter hole drilled at the top center of each sponge carrier and each sponge has a coincident 0.25 inch diameter hole drilled through its center. The holes allow for reproducible loading of the cleaner and ensure that the cleaning composition is in contact with the sponge/tile interface. The space between the sponges and a drain groove between the cleaning lanes prevents cross contamination of the compositions. Prior to testing, the sponges are washed, rinsed and wrung through a ringer to remove excess water.

The cleaning efficacy of cleaner examples 1–6 is compared with that of two commercial products, Lysol® Basin Tub and Tile Cleaner (Comparative Sample A) and Tilex® Instant Mildew Remover (Comparative Sample B). Using the modified Gardner Linear Scrubber, two different cleaners are compared on a single tile by counting the STC required to remove all the dyed artificial soap scum, as determined through visual observation of the tiles. The smaller the number of STC needed to clean the soil, the more efficacious the cleaner. Each cleaner is tested from 2 to 5 times, with the results averaged and as reported in Table 1 below.

TABLE 1

| Example or Comparative Sample | Strokes to Clean |
|---|---|
| Example 1 | 11.5 |
| Example 2 | 10.5 |
| Example 3 | 6.5 |
| Example 4 | 5.5 |
| Example 5 | 9.0 |
| Example 6 | 6.5 |
| Comparative Sample A[3] | 10 |
| Comparative Sample B[4] | 54 |

[3]Lysol is a trademark of L and F Products. Lysol Basin, Tub and Tile Cleaner contains approximately 4 weight percent tetrasodium EDTA and 6 weight percent of diethylene glycol n-butyl ether.
[4]Tilex is a trademark of Clorox. Tilex Instant Mildew Remover contains no solvent or chelant.

EXAMPLES 7 AND 8 and Comparative Sample C

Alkaline cleaner examples 7 and 8 and comparative cleaner sample C are prepared by mixing the ingredients listed in Table 2 in the order in which they appear. In making Examples 7 and 8, sufficient agitation is used to fully dissolve the sodium carbonate. The resulting cleaners are viscous gels and would be especially useful as combined soap scum/mold and mildew cleaners for vertical surfaces.

Each of the cleaners is tested for cleaning efficacy using the test described with respect to Examples 1–7. The results of that testing are as reported in Table 2.

TABLE 2

| | Parts by Weight | | |
|---|---|---|---|
| Ingredient | Example 7 | Example 8 | Comparative Sample C |
| Water (see note 2) | 88.75–89.95 | 91.1–92.30 | 94.60–95.80 |
| Sodium Carbonate | 4.5 | 3.5 | 0 |
| Dodecyldimethylamine oxide | 3.0 | 2.0 | 2.0 |
| Sodium Lauryl Sulfate | 1.1 | 0.75 | 0.75 |
| Sodium Hydroxide | 0.25 | 0.25 | 0.25 |
| Sodium Hypochlorite | 1.2 | 1.2 | 1.2 |
| Viscosity (Brookfield LV3, Spindle LV 2 @ 25 rpm) | 924 cps | 460 cps | 300 cps |
| Strokes to Clean | 18.5 | 22.3 | >60 |

As a further comparison, two commercial gel cleaners are tested. Clorox Cleanup and Soft Scrub Gel (both products of Clorox) require 59 and 58 STC to clean the test tiles, respectively.

What is claimed is:

1. A fully diluted cleaning composition having a viscosity of less than about 100 cps comprising (a) at least about 85% water, in which is dissolved (b) at least about 0.45 equivalent per kilogram of an inorganic anion which, when combined with calcium ion, forms a salt which has a solubility of not more than 0.2 g/100 g water at 25° C., wherein the anion is carbonate, fluoride, or metasilicate ion, or a mixture of such anions, (c) at least 0.3% by weight, based on the weight of the composition, of a detersive surfactant including an amine oxide of the form $RR^1R^2N{\rightarrow}O$ wherein R is $C_6$–$C_{12}$ alkyl and $R^1$ and $R^2$ are independently $C_{1-4}$ alkyl or $C_{1-4}$ hydroxyalkyl, and (d) at least about 0.5 weight percent of a bleach, based upon the weight of the composition, wherein said cleaning composition is alkaline and essentially free of chelating agents, phosphorous-containing salt, and abrasive.

2. The cleaning composition of claim 1 wherein said bleach is a chlorine-releasing bleach.

3. The cleaning composition of claim 1 which further contains at least one other anionic or nonionic surfactant.

4. The cleaning composition of claim 1 further comprising a quaternary amine disinfectant.

* * * * *